US009705227B2

(12) United States Patent
Hossaini et al.

(10) Patent No.: US 9,705,227 B2
(45) Date of Patent: Jul. 11, 2017

(54) PLUG CONTACT ELEMENT HAVING A FOLD-OVER LAYER

(71) Applicant: Tyco Electronics AMP GmbH, Bensheim (DE)

(72) Inventors: Reza Hossaini, Muhlheim am Main (DE); Matthias Haucke, Clingen (DE); Markus Ofenloch, Burstadt (DE); Peter Kraemer, Grasellenbach (DE); Ufuk Tuey, Mannheim (DE); Mohamed Aboulkassem, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/739,353

(22) Filed: Jun. 15, 2015

(65) Prior Publication Data

US 2015/0357740 A1 Dec. 10, 2015

Related U.S. Application Data

(63) Continuation of application No. PCT/EP2013/066836, filed on Aug. 12, 2013.

(30) Foreign Application Priority Data

Dec. 13, 2012 (DE) ..... 10 2012 223 082

(51) Int. Cl.
*H01R 13/428* (2006.01)
*H01R 13/432* (2006.01)
(Continued)

(52) U.S. Cl.
CPC ..... *H01R 13/428* (2013.01); *H01R 13/04* (2013.01); *H01R 43/16* (2013.01); *H01R 13/432* (2013.01)

(58) Field of Classification Search
CPC .... H01R 13/428; H01R 13/432; H01R 13/04; H01R 24/28
(Continued)

(56) References Cited

U.S. PATENT DOCUMENTS 3,284,758 A * 11/1966 Klumpp, Jr. ..... H01R 13/04 439/869
3,470,529 A 9/1969 Klumpp, Jr.
(Continued)

FOREIGN PATENT DOCUMENTS

CN 102394406 A 3/2012
DE 10006920 A1 9/2000
(Continued)

OTHER PUBLICATIONS

International Search Report, International Application No. PCT/EP2013/066836, dated Apr. 11, 2013, 7 pages.
(Continued)

*Primary Examiner* — Harshad Patel
(74) *Attorney, Agent, or Firm* — Barley Snyder

(57) ABSTRACT

A contact element is disclosed and includes a body of contact material, a mating plug end, a conductor end, and a fold-over layer of the contact material. The mating plug end is positioned at one end of the body, while the conductor end is positioned an opposite end of the body with respect to the mating plug end. The mating plug end includes a conductor-side cross-width less than a plug-side cross-width of the mating plug end. The fold-over layer of the contact material is disposed along at the mating plug end.

8 Claims, 7 Drawing Sheets

(51) Int. Cl.
*H01R 13/04* (2006.01)
*H01R 43/16* (2006.01)

(58) Field of Classification Search
USPC ..... 439/852, 884, 888, 889.89, 733.1, 869, 439/877, 878, 879, 886
See application file for complete search history.

(56) References Cited

U.S. PATENT DOCUMENTS 3,513,438 A 5/1970 Henschen et al.
3,530,429 A * 9/1970 Scheller ..... H01R 13/04 439/746
3,742,432 A 6/1973 Curtis et al.
4,235,497 A 11/1980 Simon
5,007,855 A * 4/1991 O'Brien ..... H01R 4/2408 439/411
5,207,603 A * 5/1993 Peloza ..... H01R 13/04 439/872
5,567,187 A 10/1996 Bellinger
5,795,197 A 8/1998 Tsuji et al.
5,823,834 A 10/1998 Straeb et al.
5,989,080 A * 11/1999 Tsuji ..... H01R 13/055 439/877
2003/0119383 A1 6/2003 Sai et al.
2011/0124244 A1* 5/2011 Osvatic ..... H01R 13/055 439/819

FOREIGN PATENT DOCUMENTS

JP 103956 A 1/1998
JP 2007207501 A 8/2007

OTHER PUBLICATIONS

Abstract of JP2007207501, dated Aug. 26, 2007, 1 page.
Abstract of JPH103956, dated Jan. 6, 1998, 2 pages.
Abstract of DE10006920, dated Sep. 14, 2000, 2 pages.
Chinese Office Action, dated Jul. 29, 2016, 10 pages.
Abstract of CN102394406, dated Mar. 28, 2012, 1 page.

* cited by examiner

PLUG CONTACT ELEMENT HAVING A FOLD-OVER LAYER

CROSS-REFERENCE TO RELATED APPLICATIONS

This application is a continuation of PCT International Application No. PCT/EP2013/066836 filed Aug. 12, 2013, which claims priority under 35 U.S.C. §119 to German Application No. 10 2012 223 082.3 filed Dec. 13, 2012.

FIELD OF THE INVENTION

The invention relates to a contact element and, more particularly, a contact element for a plug type connector.

BACKGROUND

Contact elements, in particular plugs, have been known for a long time and are used in numerous electrical and electronic devices. Through repeated attachment to and release from a mating-contact element, contact elements are generally subject to great stress, such that the contact elements should be strong enough for the applied stresses. This is normally realized through high material strength along the plug end thereof. In contrast, the contact element generally has a low material strength along the conductor end in order to connect it to a conductor, for example by means of a pressing method, such as crimping.

Previously, such known contact elements have been manufactured by shaping them from one piece of a starting material by means of machining methods such as milling, for example. The resulting surfaces frequently still have to be smoothed and/or coated. This production method requires many production steps and consumes a lot of material due to the abrasion and, therefore, is complex and expensive.

An additional known method is the joining of segments of different thicknesses to make one contact element. This method, too, is complex and thus cost-intensive because the segments must normally be inseparably connected to one another, for example by welding.

SUMMARY

An objection of the invention, among others, is to provide a contact element which can be produced simply and inexpensively, and a method for producing such a contact element.

A contact element is provided and includes a body of contact material, a mating plug end, a conductor end, and a fold-over layer of the contact material. The mating plug end is positioned at one end of the body, while the conductor end is positioned an opposite end of the body with respect to the mating plug end. The mating plug end includes a conductor-side cross-width less than a plug-side cross-width of the mating plug end. The fold-over layer of the contact material is disposed along at the mating plug end.

BRIEF DESCRIPTION OF THE DRAWINGS

Hereinafter, the invention is explained by way of example using two exemplary embodiments with reference to the drawings.

DETAILED DESCRIPTION OF THE EMBODIMENT(S)

The invention will now be described in more detail with reference to the figures.

Figure 1:
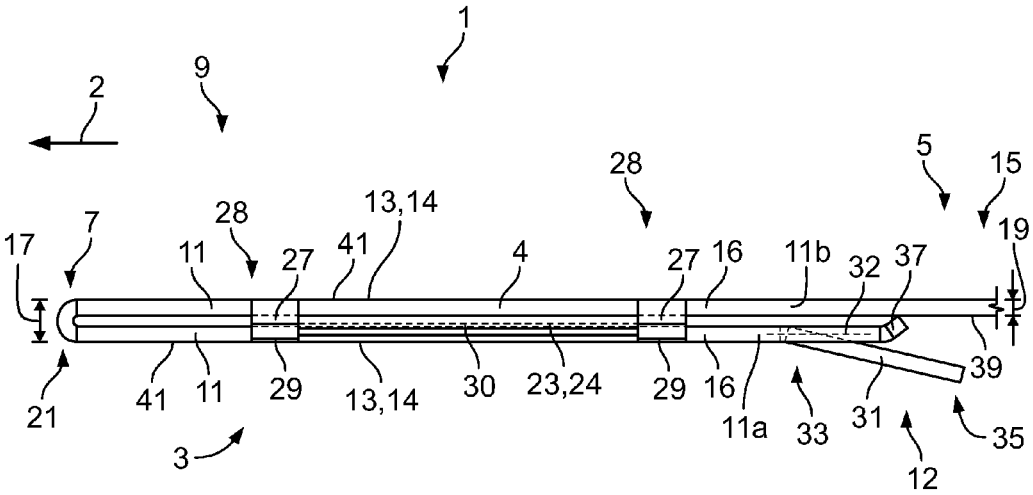
FIG. 1 is a top view of a contact element according to the invention.

With reference to FIG. 1, a contact element 1 according to the invention will be described. The contact element 1 includes of a contact material 4, a plug end 3 for plugging together with a mating-contact element, and a conductor end 5 for connection to an electrical conductor.

The contact element 1 includes two contact layers 11: a plug layer 11*b* which is continuous from the conductor end 5 to the plug end 3 and a shorter folded layer 11*a* extending over the plug end 3. The two contact layers 11*a* and 11*b* together form a multilayer region 9. The folded layer 11*a* has an open end 12 extending to the conductor end 5.

The plug end 3 is substantially formed from the multilayer region 9. The multilayer region 9 is formed by folding over the contact material 4. The two contact layers 11*a* and 11*b* are positioned substantially parallel relative to one another and spaced apart from one another. A fold-over layer 7 of the contact material is provide along one end of the contact element 1 and 4 becomes tapered as the fold-over layer 7 extends toward the plug end 3. The fold-over layer 7 forms the head 21 of the contact element 1. As shown, the plug-side cross-width 17 is larger than the conductor-side cross-width 19.

Spacers 23 a provided between the two contact layers 11*a* and 11*b* of the multilayer region 9 at a defined spacing relative to one another. The spacer 23 is formed from a structured region 24 of the folded layer 11*a*. An edge 30 of the folded layer 11*a* is reshaped as a spacer 23 in the direction of the plug layer 11*b*. The spacer 23 is in abutment with the plug layer 11*b*, which in this case is the contact layer 11 adjacent to the folded layer 11*a*.

The spacers 23 are bordered by the fasteners 27. The fasteners 27 are formed by reshaping a region of the plug layer 11*b*. In the mounted state 28, fasteners 27 are positioned in and form-fitted with fastener receiving passageways 29 in the folded layer 11*a*. The fasteners 27 are pressed into the fastener receiving passageways 29. The fasteners 27 connect the two contact layers 11*a* and 11*b* of the multilayer region 9 to one another, such that the contact layers 11*a* and 11*b* cannot be separated from one another. The fasteners 27 and spacers 23 therefore ensure the dimensional stability of the contact element 1.

The fasteners 27 can be tapered in the direction of the fastener receiving passageways 29. Similarly, the fastener receiving passageways 29 can be expanded in the direction of fasteners 27. As a result, pressing is facilitated during production.

Outer sides 14 of the outer contact layers 16 form the contact region 13 of the contact element 1. This contact region 13 is substantially smooth and continuous and, therefore, such a design is particularly advantageous for the plugging-together the contact element 1 with a mating-contact element, such as a female connector.

If the fold-over layer 7 is formed by bending the contact material 4, the head 21 can be rounded. This facilitates the insertion of the contact element 1 into a mating-contact element. In contrast, if the fold-over layer 7 is formed by edge-forming methods such as folding, the head 21 can have edges which, if tapering of the fold-over layer 7 in the plugging direction 2 is maintained, such a design facilitates insertion of the contact element 1 into a mating-contact element in an easy motion.

A locking arm 31 extends in the direction of the conductor end 5, from the open end 12 of the folded layer 11*a*. A free locking arm end 35, thereof, is spaced apart from the fold-over layer plane 32 of the contact element 1 and extends substantially in the direction of the conductor end 5. The locking arm 31 can serve to attach the contact element 1 in a contact housing.

Supports 37 extend from the open end 12 in the direction of the conductor end 5. The supports 37 are in abutment with a surface 39 on the inner side of the plug layer 11*b*. In the region of the locking arm 31, the supports 37 keep the two contact layers 11*a* and 11*b* of the multilayer region 9 spaced apart from one another.

If a force is exerted onto the locking arm 31, in the direction of the adjacent plug layer 11*b*, through stress of the contact element 1, the supports 37 prevent the two contact layers 11*a* and 11*b* from pressing together. As a result, the cross-width 17 of the multilayer region 9 is preserved, which guarantees the safe seating of the contact element 1 in a mating-contact element.

The conductor end 5 of the contact element 1 is used to connect to an electrical conductor, such as a cable, for example. Since the conductor end 5 is substantially formed from a single-layer region 15, it is particularly well-suited to contact a conductor, in particular, for crimping.

Figure 2:
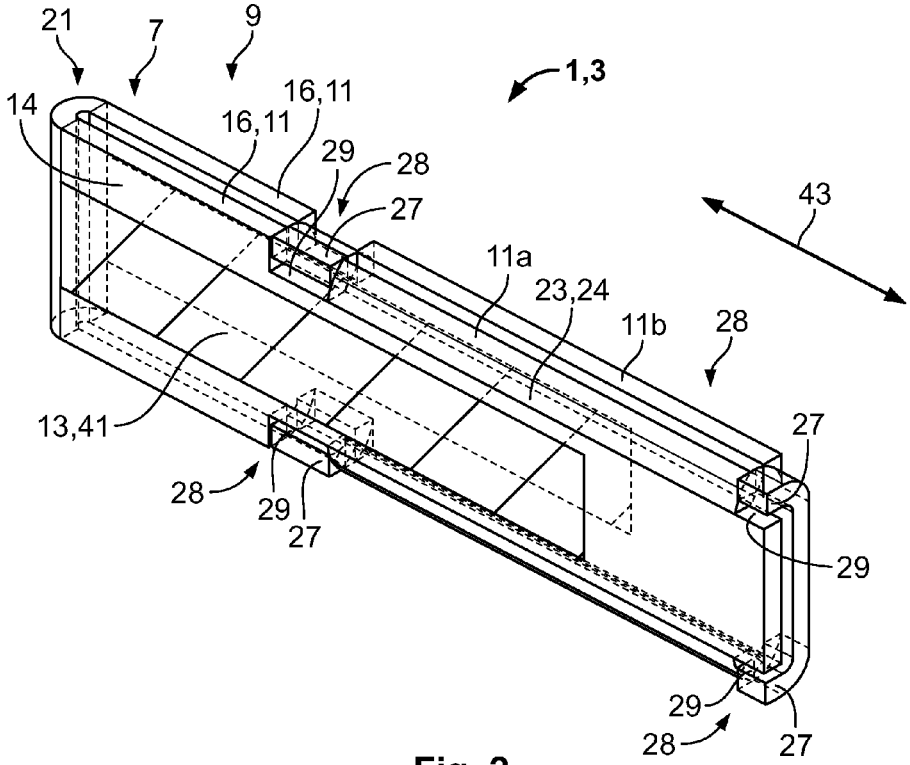
FIG. 2 is a front perspective view of a plug end of the contact element according to the invention.

As shown in FIG. 2, the pair of fasteners 27 is shown. The contact region 13 is substantially formed from the outer contact layers 16 of the multilayer region 9. The surface 41 of the contact region 13 is substantially smooth and extends continuously from the plug end 3 in the direction of the conductor end 5.

The contact region 13 is free of disturbances such as burrs, seams, welding points or apertures. It facilitates contact between the contact element 1 and a mating-contact element. In particular, such a design facilitates easy motion and a disturbance-free electrical connection with the mating-contact element.

The fasteners 27 are formed by reshaping a region of the plug layer 11*b*. They are received in fastener receiving passageways 29 of the folded layer 11*a*. The spacers 23 are bordered by the fasteners 27 in the longitudinal direction 43.

Figure 3:
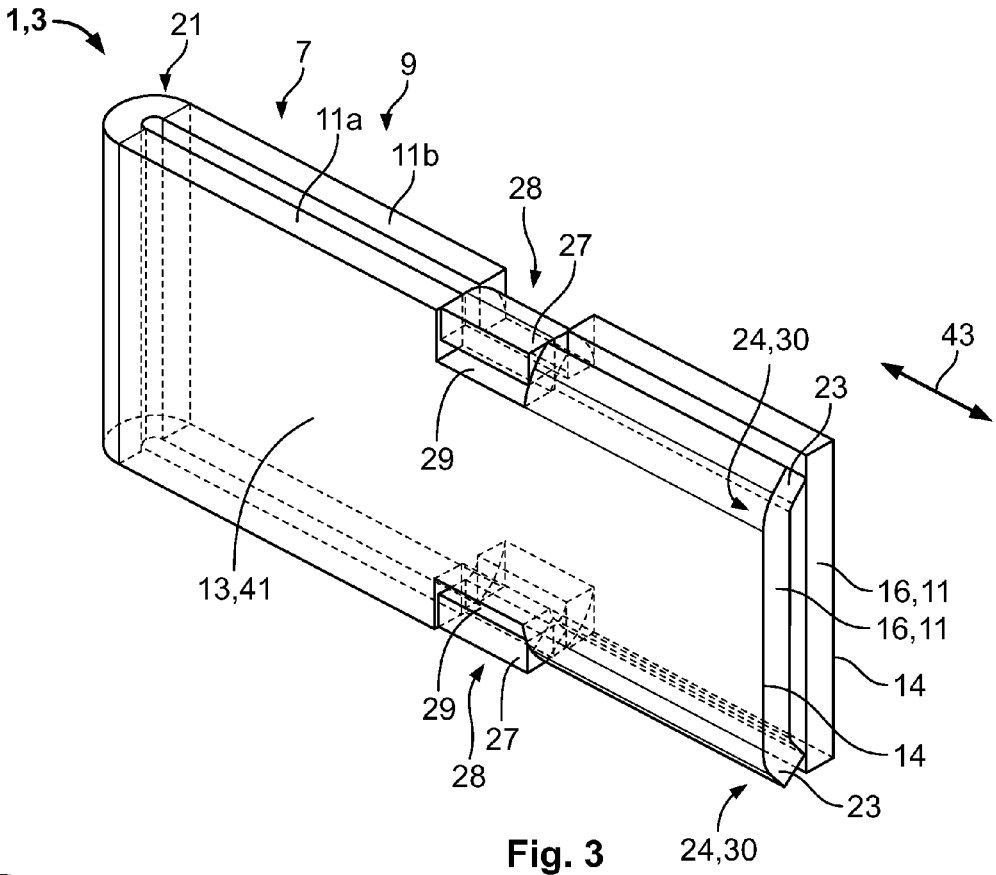
FIG. 3 is a close-up front perspective view of the plug end of FIG. 2.

With reference to FIG. 3, the plug end 3 is shown with a region with the spacers 23 formed from structured regions 24 of the folded layer 11*a* in the multilayer region 9. The edges 30 of the folded layer 11*a* are reshaped along the longitudinal direction 43 of the contact element 1 in the direction of the plug layer 11*b*. The spacers 23 depicted in FIG. 3 are reshaped by bending the edges 30. They can also be formed by folds or other reshaping methods.

The reshaped edges 30 form the spacers 23 and are in abutment with the plug layer 11*b*. The spacers 23 keep the two contact layers 11*a* and 11*b* of the multilayer region 9 spaced apart relative to one another. The spacers 23 are bordered in the longitudinal direction by the fasteners 27.

The spacers 23 are formed continuously between the bordering fasteners 27 and are in continuous abutment with the plug layer 11*b*. They can alternatively also be formed from several reshapings. Instead of bending methods, other methods, such as punching or embossing, can also be used to produce the spacers.

Figure 4:
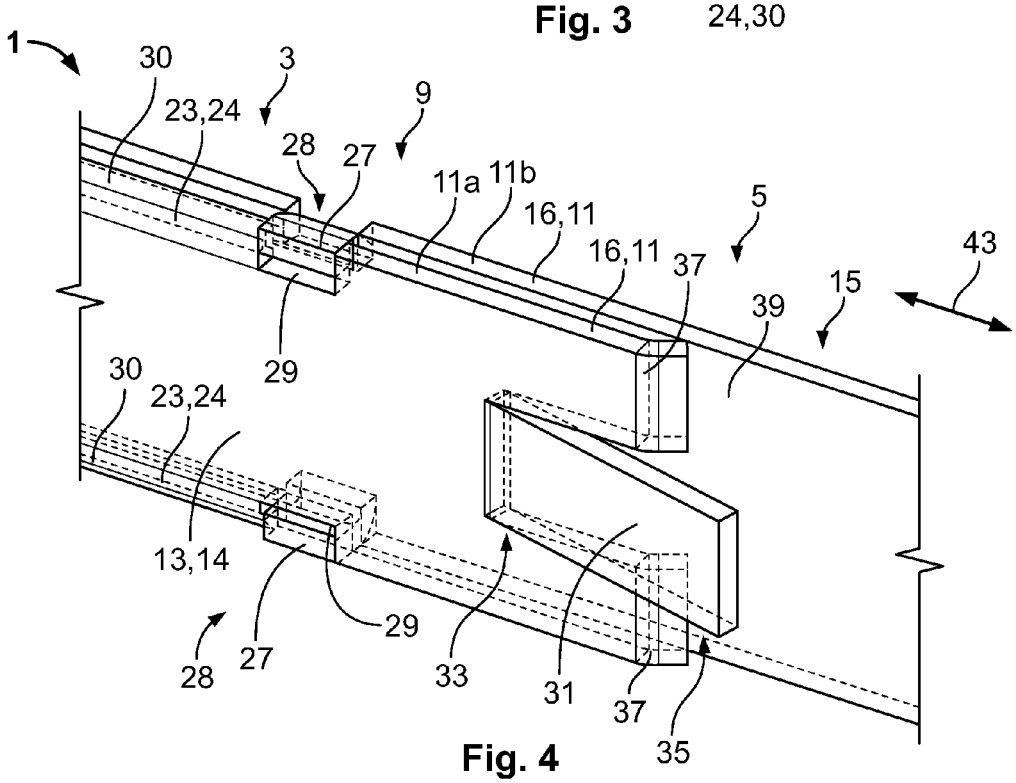
FIG. 4 is a close-up front perspective view of locking arm of contact element according to the invention.

Now with reference to FIG. 4, a region around the locking arm 31 of will be described.

The locking arm 31 extends from the folded layer 11*a* in the direction of the conductor end 5 of the contact element 1. The locking arm 31 points away from the contact element 1 in this case. The base 33 of the locking arm 31 is connected to the folded layer 11*a*. If the contact element 1 is mounted in a suitable receiver, such as a plug housing, the locking arm end 35 can be in direct contact with this and serves to secure the contact element 1.

The supports 37 extend from the folded layer 11*a* in the direction of the conductor end 5. The supports 37 are formed from structured regions of the folded layer 11*a*. The supports 37 shown in FIG. 4 are reshaped by bending. Alternatively, supports can also be formed by other suitable methods, such as embossing for example.

The supports 37 are in abutment with a surface 39 of an inner side of the adjacent plug layer 11*b*. In the longitudinal direction 43, the supports 37 are in abutment with the surface 39 of the plug layer 11*b* between the base 33 and the locking arm end 35 of the locking arm 31.

Figure 5:
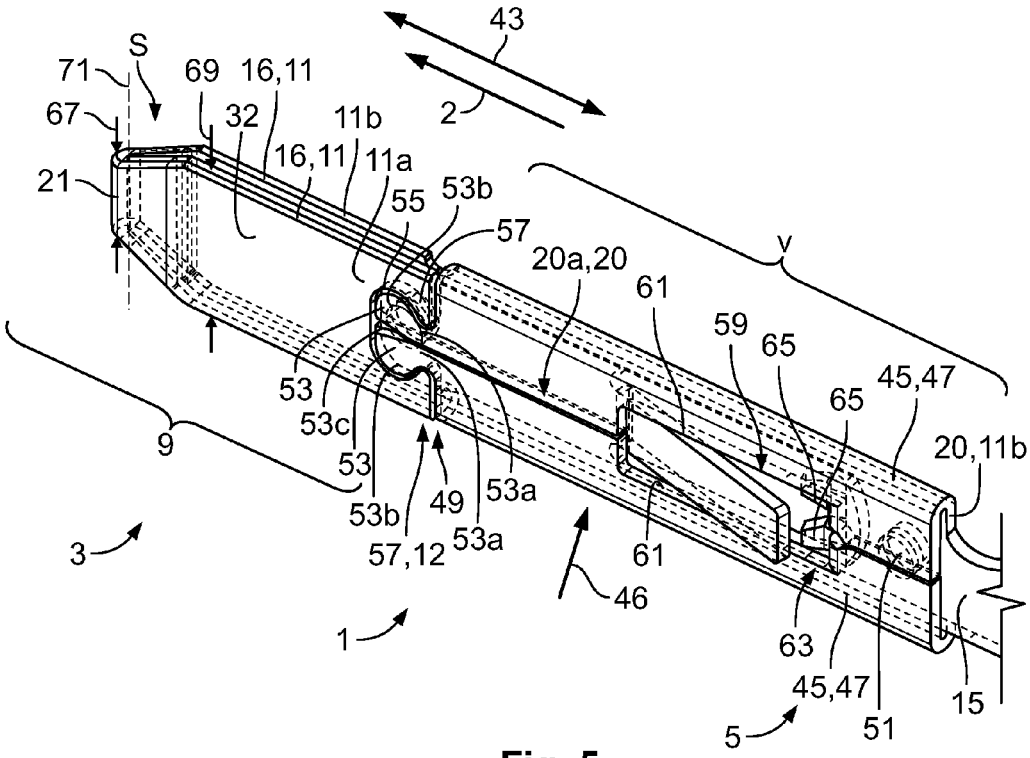
FIG. 5 is a front perspective view of another contact element according to the invention.

Now with reference with FIG. 5, another contact element 1 according to the invention is shown.

For components which correspond in terms of function and/or design to the components of the previously described exemplary embodiment from FIGS. 1 to 4, the same reference signs are used. For the sake of brevity, only the differences relative to the previously described exemplary embodiment are explored.

The contact element 1 has a reinforcement region V which extends from the end of the multilayer region 9 in the direction of the conductor end 5. Compared to the previous exemplary embodiment, the folded layer 11*a* is shortened at its open end 12.

The reinforcement region V has two bent regions 45 running parallel to the longitudinal direction 43, which are formed by folding over the edges 47 of the plug layer 11*b* which run parallel to the longitudinal direction 43 in an fold-over direction 46 to the contact element 1.

When manufacturing the contact element 1, the plug layer 11*b* can firstly be made broader than in the previously described exemplary embodiment in order to provide contact material 4 for the longitudinal bent regions 45 of the edges 47.

The longitudinal bent regions 45 form a fold-around layer 20*a* which is substantially parallel to the plug layer 11*b* and which adjoins, at its end 49 pointing in the plugging direction 2, the folded layer 11*a* of the multilayer region 9.

The fold-around layer 20*a* and the plug layer 11*b* represent the reinforcement layers 20 in the reinforcement region V.

In this exemplary embodiment, the fold-around layer 20*a* is formed from two folded-over edges 47 of the plug layer 11*b*. Alternatively, the fold-around layer 20*a* can be formed from the fold-over of a single edge 47 of the plug layer 11*b*.

The reinforcement layers 20 lend additional stability to the contact element 1.

To prevent the reinforcement layers 20 of the contact element 1 from pressing together in the reinforcement region V, the plug layer 11*b* has spacers 51. These can be molded in the plug layer 11*b* by suitable techniques such as stamping, punching or bending.

For dimensionally stable connection to the folded layer 11*a* of the multilayer region 9, the fold-around layer 20*a* includes connection extensions 53. The connection extensions 53 are inserted in into a complementary receiving aperture 55 in the folded layer 11*a* in a form-fitting manner.

The receiving aperture 55 is keyhole shaped in the shown embodiment and extends to the conductor end 57 of the folded layer 11*a*, such that the connection extensions 53 extending from the fold-around layer 20*a* can engage in the receiving apertures 55.

The connection extensions 53 have neck regions 53*a* and head regions 53*b*. The receiving aperture 55 has an protrusion 55*a*. The protrusion 55*a* engages the neck region 53*a* of the connection extensions 53.

There is a deformation region 53*c* between the head regions 53*b*. When the connection extensions 53 are pressed into the receiving aperture 55, the head regions 53*b* are pressed elastically in the direction of the deformation region 53*c* and exert a pressure on the receiving aperture 55. As a result, the folded layer 11*a* is connected in a frictionally engaging and form-fitting manner to the reinforcement layer 20.

This secures the connection of the folded layer 11*a* to the fold-around layer 20*a* against tractive and pressure forces along the longitudinal direction 43 and transverse to this.

In this example, the locking arm 31 extends out from the plug layer 11*b*. The fold-around layer 20*a* has a locking arm receiving section 59, through which the locking arm 31 protrudes starting from the plug layer 11*b*. The locking arm receiving section 59 is substantially rectangular, with its longitudinal sides 61 running parallel to the longitudinal direction 43 of the contact element 1.

The locking arm receiving section 59 is dimensioned and arranged such that the locking arm 31 can protrude unimpeded through this and therefore can be used.

At the conductor end 63 of the locking arm receiving section 59, there are two securing elements 65 which prevent the locking arm 31 from bending back in the direction of the plug layer 11*b*. The securing elements 65 are formed from deformed regions of the fold-around layer 20*a* and extend in the direction of the plug end 3 into the locking arm receiving section 59.

At the plug end 3 of the contact element 1, there is a head region S. In this, the multilayer region 9 is tapered in the plugging direction 2, such that a head width 67 is smaller than a plug width 69.

In this case, the head width 67 indicates the width of the head 21 along an axis 71 perpendicular to the plugging direction 2 and parallel to the fold-over layer plane 32.

The plug width 69 indicates the width of the contact element 1 in the multilayer region 9 outside the head region S. The plug width 69 is measured parallel to the axis 71.

The single-layer region 15 adjoins the conductor end 5 at the reinforcement region V.

Figure 6:
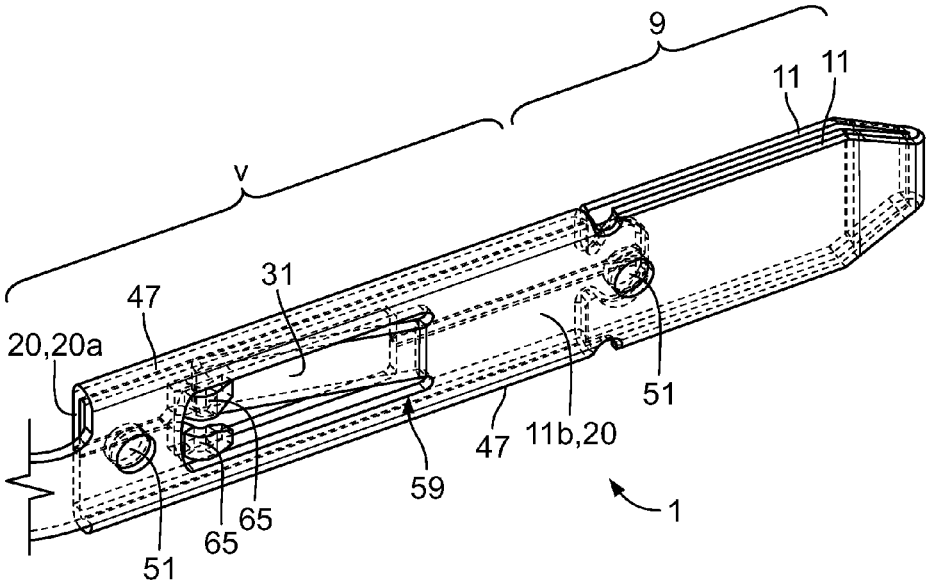
FIG. 6 is a rear perspective view of the contact element of FIG. 5.

As shown in FIG. 6, the plug layer 11*b* has the spacers 51, which keeps the fold-around layer 20*a* spaced apart from the plug layer 11*b* and prevents an undesired pressing-together of the layers 11*b* and 20*a*. The spacers 51 are formed by way of stamping in or other suitable deformation techniques into the plug layer 11*b*. The two folded-over edges 47 are in abutment with these spacers 51.

The securing elements 65 are configured in the shape of a hook in the shown embodiment. The securing elements 65 are connected to the fold-around layer 20*a* or extend out from this.

The securing elements 65 are firstly bent in the direction of the plug layer 11*b* and then point in the direction of the locking arm 31. The securing elements 65 prevent the locking arm 31 from bending back into the contact element 1, such that the function of the locking arm 31 is preserved.

Now with reference to FIGS. 7 and 8, another contact element 1 according to the invention will be described.

Figure 7:
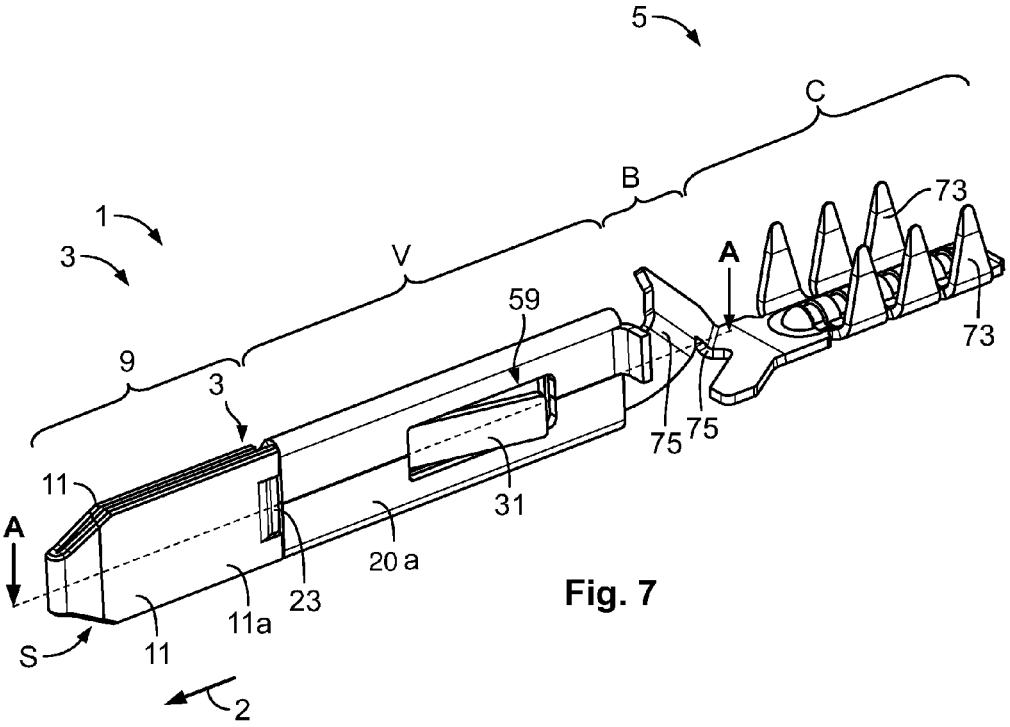
FIG. 7 is a front perspective view of another contact element according to the invention.
Figure 8:
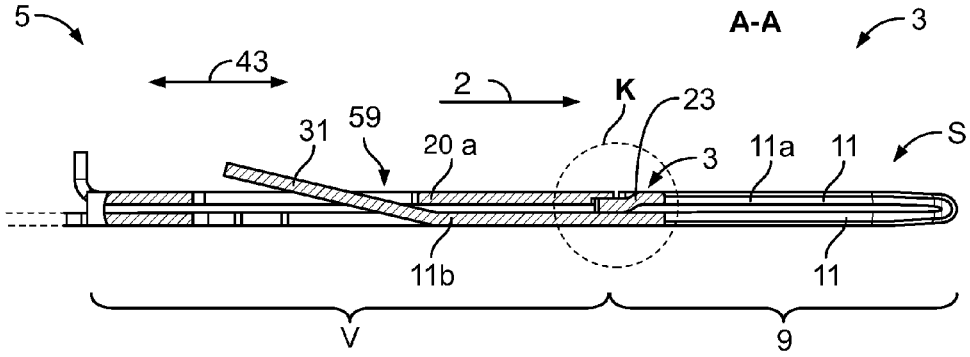
FIG. 8 is a top sectional view of the contact element of FIG. 7 along line A-A.

Like the second embodiment, the contact element 1 shown in FIGS. 7 and 8 has a multilayer region 9 and a reinforcement region V. The multilayer region 9 extends in the plugging direction 2. A crimp region C joins the reinforcement region V and positioned opposite to the plugging direction 2. The crimp region C includes crimping teeth 73 which are situated transverse to the longitudinal direction 43 and which act as a connection to foil conductors (not shown) or a cable (not shown). A bending section B is provided and arranged between the crimp region C and the reinforcement region V. The bending section B includes a plurality of bending regions 75, which can serve to orient the plug end 3 if the contact element 1 is connected to an electrical wire at its crimp region C.

As in the previously described exemplary embodiments, the multilayer region 9 consists of two contact layers 11, which are parallel to one another except along the head region S.

The contact element 1 includes a spacer 23 which extends from the folded layer 11*a* in the direction of the reinforcement region V. The spacer 23 is in this case formed from a reshaped edge 30 of the folded layer 11*a*. The edge 30 runs transverse to the plugging direction 2 and is arranged at an end of the folded layer 11*a* adjacent to the reinforcement region V.

Figure 9:
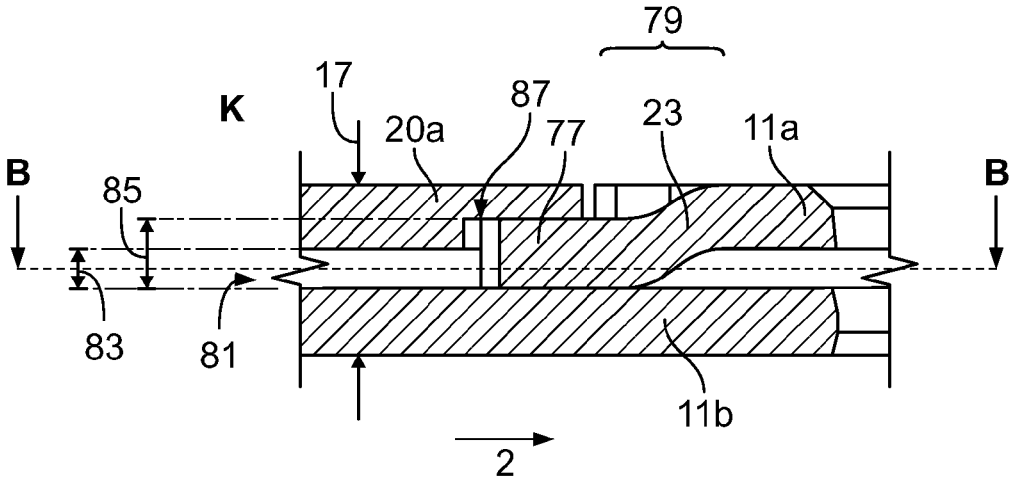
FIG. 9 is a close up sectional view of the contact element of FIG. 8 showing section K.
Figure 10:
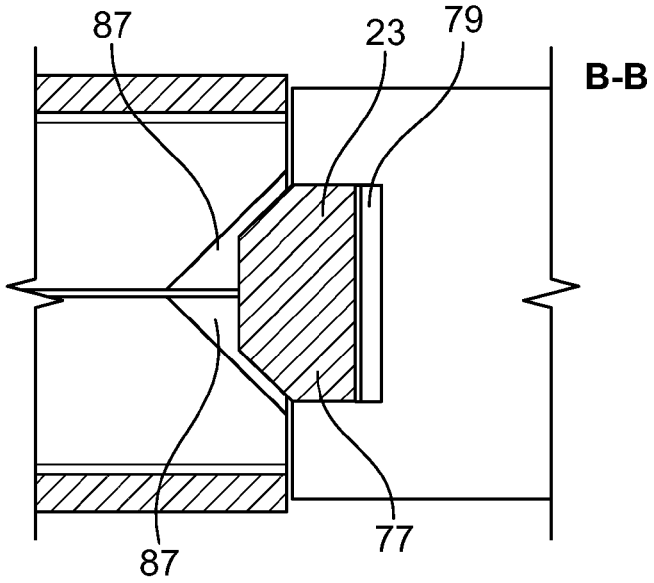
FIG. 10 is close up sectional view of the contact element of FIG. 9 along line B-B.

The spacer 23 is described in greater detail with reference to FIGS. 9 and 10.

The contact element 1 has a locking arm 31, which extends starting from the plug layer 11*b* counter to the plugging direction 2. In this case, the locking arm 31 protrudes through the fold-around layer 20*a* which, like the plug layer 11*b*, has a locking arm receiving section 59.

The spacer 23 extends from the folded layer 11*a* and toward the conductor end 5. The spacer 23 has a support region 77 and an offset section 79. In the offset section 79, the contact material 4 is offset from the folded layer 11*a* in the direction of the plug layer 11*b*. At its end, which points towards the conductor end 5, the support region 77 is arranged between the fold-around layer 20*a* and the plug layer 11*b*. The support region 77 of the spacer 23 separates the fold-around layer 20*a* and the plug layer 11*b* away from one another in the reinforcement region V. Since the support region 77 is in abutment with the plug layer 11*b*, the folded layer 11*a* is supported in the multilayer region 9 against the plug layer 11*b*.

The intermediate space 81 extends between the plug layer 11*b* and the fold-around layer 20*a*. The width 83 of the intermediate space 81 is smaller than a thickness 85 of the contact material 4. In order to be able to arrange the support region 77 between the fold-around layer 20*a* and the plug layer 11*b* in the case of a given plug-side cross-width 17, the fold-around layer 20*a* has two fastener receiving passageways 87 which are triangular in the section plane B-B (See FIG. 10).

The fastener receiving passageways 87 can be produced, for example by pressing the corresponding regions of the fold-around layer 20*a*. Alternatively, instead of the fastener receiving passageways 87 in the fold-around layer 20*a*, there can be a recess at the support region 77, such that this can be inserted between the fold-around layer 20*a* and the plug layer 11*b*. The fastener receiving passageways 87 extend substantially parallel to the fold-around layer 20*a*. They do not necessarily have to be triangular. The shape depends on the shape of the support region 77. In the exemplary embodiment shown, the support region 77 is configured to be trapezoid in the section plane B-B (see FIG. 10), with the tip of the trapezium pointing in the direction of the conductor end. The triangular fastener receiving passageways 87 are designed for receiving the trapezoid support region 77.

Figure 11:
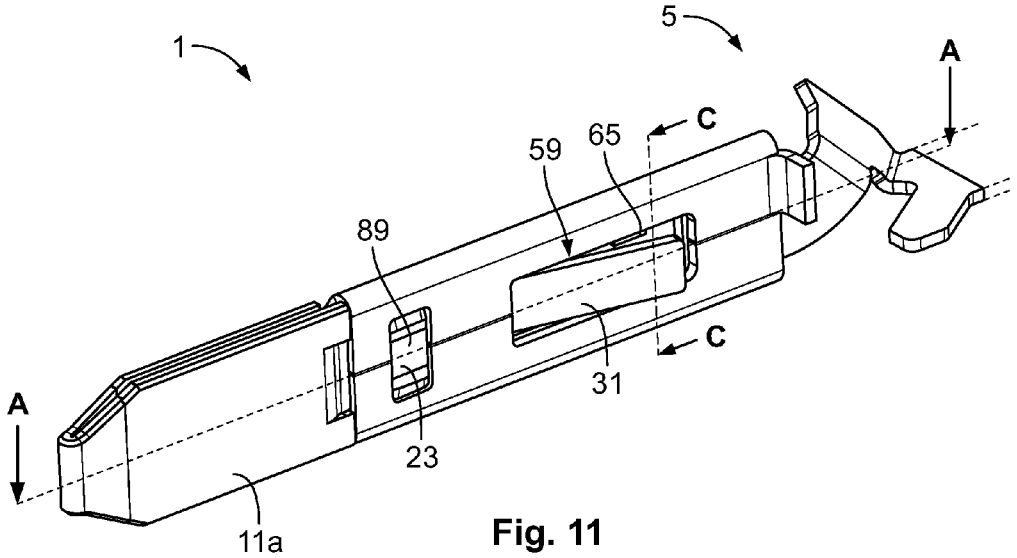
FIG. 11 is a perspective view of another contact element according to the invention.
Figure 12:
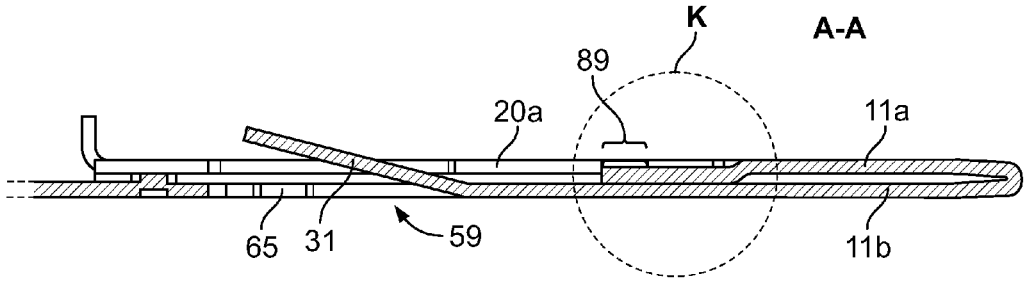
FIG. 12 is a top sectional view of the contact element of FIG. 11 along line A-A.

Now with respect to FIGS. 11 and 12, another embodiment of a contact element 1 according to the invention will be described. In The shown embodiment substantially corresponds to the previously described embodiments. Therefore, only the differences shall be explored at this point for the sake of brevity.

The contact element 1 has a spacer 23 that extends from the folded layer 11*a* in the direction of the conductor end 5. However, the spacer 23 has a securing section 89 at its end pointing towards the conductor end 5. The spacer 23 and the securing section 89 are described in greater detail with reference to FIGS. 13 and 14. The contact element 1 has a locking arm 31, which corresponds to the locking arm 31 of the second and third embodiments. In order to avoid the locking arm 31 bending back in the direction of the plug layer 11*b* or through the locking arm receiving section 59 in the plug layer 11*b* and the fold-around layer 20*a*, two securing elements 65, which extend from the plug layer 11*b* and face one another, are present in the locking arm receiving section 59. The securing elements 65 are described in greater detail with reference to FIG. 15.

Figure 13:
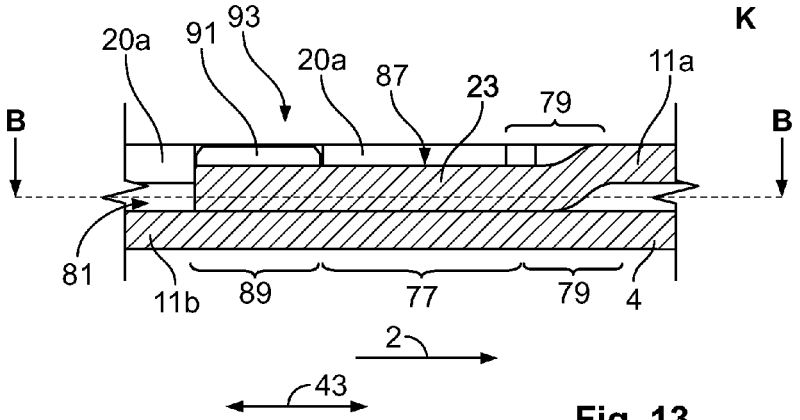
FIG. 13 is a close up sectional view of the contact element of FIG. 12 showing section K.
Figure 14:
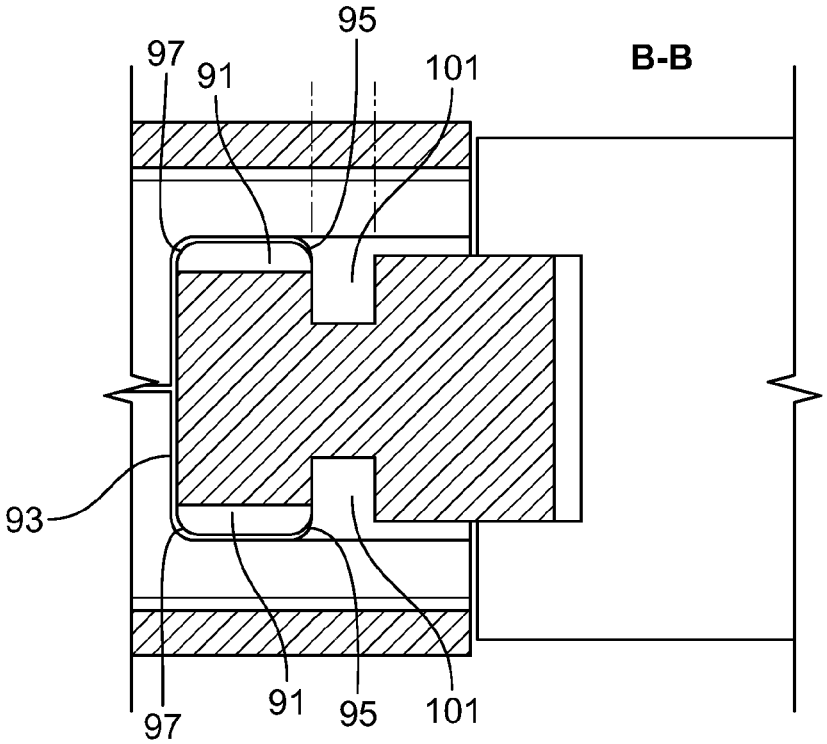
FIG. 14 is close up sectional view of the contact element of FIG. 13 along line B-B.

As shown in FIGS. 13 and 14, the spacer 23 extends from the folded layer 11*a* and toward the conductor end 5. The offset section 79 offsets the contact material 4 from the folded layer 11*a* between the plug layer 11*b* and the fold-around layer 20*a*. The support region 77 is in abutment with the plug layer 11*b*. As a result, the plug layer 11*b* is supported against the folded layer 11*a*. The fold-around layer 20*a* is likewise in abutment with the support region 77 and, additionally, is supported against the plug layer 11*b*.

At the end of the spacer 23 pointing counter to the plugging direction 2, there is the securing section 89. The securing section 89 has securing wings 91, which extend outwardly away from the plug layer 11*b*. The fold-around layer 20*a* has an edge receiving section 93, into which the securing wings 91 extend. The securing wings 91 thus form, in the longitudinal direction 43, a form-fit with the fold-around layer 20*a*. As a result, it is possible to prevent any slipping of the folded layer 11*a* in the longitudinal direction 43. This is a particular advantage when the contact element 1 is introduced into a mating-contact element (not shown) or released from this and when a large force acts on the folded layer 11*a* and the plug layer 11*b* between the contact element 1 and the mating-contact element.

In order to guide the spacer 23 with its support region 77 under the fold-around layer 20*a* up to the edge receiving section 93, the fold-around layer 20*a* has a recess 87. The recess 87 can be formed, for example, by pressing the contact material 4 of the fold-around layer 20*a* in the region above the spacer 23. In order to facilitate the manufacture of the contact element 1 and to keep some play between the edges of the securing wings 91 and the fold-around layer 20*a*, the edges 95 and 97 are rounded. Thereby, the rounding of the front edges 95 preferably have a smaller radius than the rounding of the rear edges 97. The front edges 95 are less rounded in order to increase the form-fitting of the securing section 89 in plugging direction 2 with the fold-around layer 20*a*. As a result, it is difficult for the spacer 23 to slip out of the intermediate space 81. The rear edges 97 are less rounded in order to form-fit between the securing section 89 and the edge 99 of the edge receiving section 93, there is a form-fit between the folded layer 11*a* and the fold-around layer 20*a*. The rounding facilitates the assembly of the contact element 1 and prevents sharp edges or tips from protruding out of the contact element 1, in particular because the securing wings 91 may protrude from the edge receiving section 93, for example after the contact element 1 is stressed. In order to facilitate bending of the securing wings 91 during manufacture, in a direction away from the plug layer 11*b*, two fastener receiving passageways 101 are provided along the longitudinal direction 43, between the securing wings 91 and the remaining spacer 23.

Figure 15:
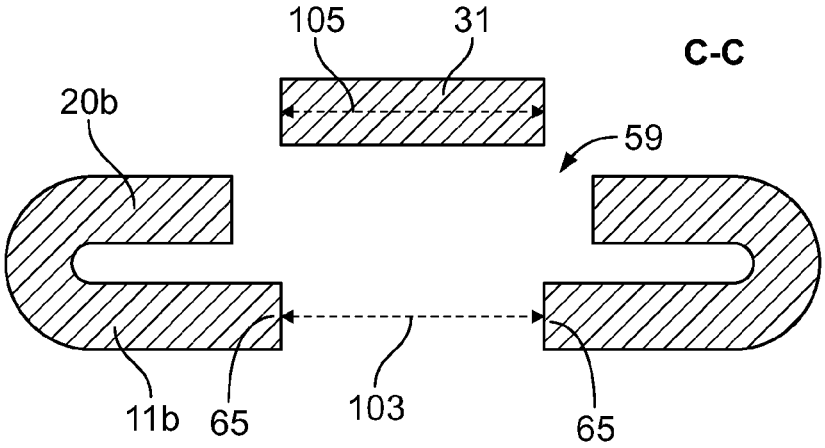
FIG. 15 is a close up sectional view of the contact element of FIG. 14 along line C-C.

As shown in FIG. 15, the locking arm 31 extends through the locking arm receiving section 59 in the fold-around layer 20*a* and the plug layer 11*b* away from the plug layer 11*b*. The securing elements 65 seal the locking arm receiving section 59 in the plug layer 11*b* and prevent the locking arm 31 from undesirably bending through the plug layer 11*b*. In one manufacturing step (not shown), the locking arm 31, before it is bent, is in a plane with the plug layer 11*b*. In this case, it is connected to the securing elements 65. After the locking arm 31 breaks free, and after bending away out of the plug layer 11*b*, the securing elements 65 are formed by pressing such that their spacing 103 is smaller than the width 105 of the locking arm 31.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A contact element, comprising:

a body;

a mating plug end located at one end of the body;

a conductor end located at an opposite end of the body with respect to the mating plug end and having a conductor-side cross-width being less than a plug-side cross-width of the mating plug end;

a fold-over layer disposed along the mating plug end forming a multilayer region having a pair of contact layers;

a first spacer formed as a bent edge of one of the pair of contact layers and extending between the pair of contact layers, the first spacer abutting an adjacent contact layer of the pair of contact layers; wherein the first spacer is formed from a structured region of the contact; outer contact layers of the multilayer region are formed by the pair of contact layers; wherein one of the pair of contact layers includes a fastener received in a complementary recess disposed along another of the pair of contact layers; wherein the fastener is frictionally fit together with the complementary recess; wherein the fastener is tapered in a direction of the complementary recess; a projecting locking arm extending from the mating plug end toward the conductor end; the projecting locking arm includes a base and a free locking arm end opposite the base; and a support extending from the mating plug end and toward the conductor end and abutting a surface of the adjacent contact layer of the pair of contact layers.

2. The contact element according to claim 1, wherein the support abuts the adjacent contact layer between the base and the free locking arm end.

3. The contact element according to claim 1, further comprising a reinforcement region extending behind the multilayer region and toward the conductor end and having a pair of reinforcement layers.

4. The contact element according to claim 3, wherein the reinforcement region includes a bent region that is folded transverse to the fold-over layer.

5. The contact element according to claim 4, wherein one of the pair of reinforcement layers includes a second spacer separating the pair of reinforcement layers.

6. The contact element according to claim 4, wherein one of the pair of reinforcement layers is connected to one of the pair of contact layers of the multilayer region.

7. The contact element according to claim 6, wherein one of the pair of reinforcement layers receives a locking arm that extends out of the other reinforcement layer of the pair of reinforcement layers.

8. The contact element according to claim 7, wherein the reinforcement region includes a securing element preventing the locking arm from bending.

* * * * *